US011622610B2

(12) United States Patent
Smal

(10) Patent No.: US 11,622,610 B2
(45) Date of Patent: Apr. 11, 2023

(54) HAIR-STYLING DEVICE

(71) Applicant: BABYLISS FACO SPRL, Wandre (BE)

(72) Inventor: Olivier Smal, Magnee (BE)

(73) Assignee: BABYLISS FACO SPRL, Wandre (BE)

( * ) Notice: Subject to any disclaimer, the term of this patent is extended or adjusted under 35 U.S.C. 154(b) by 616 days.

(21) Appl. No.: 16/470,796

(22) PCT Filed: Dec. 4, 2017

(86) PCT No.: PCT/EP2017/081303

§ 371 (c)(1),
(2) Date: Jun. 18, 2019

(87) PCT Pub. No.: WO2018/114294

PCT Pub. Date: Jun. 28, 2018

(65) Prior Publication Data

US 2019/0380465 A1 Dec. 19, 2019

(30) Foreign Application Priority Data

Dec. 23, 2016 (EP) ..... 16206630

(51) Int. Cl.

| | |
|---|---|
| ***A45D 19/00*** | (2006.01) |
| ***A45D 19/16*** | (2006.01) |
| ***A45D 1/04*** | (2006.01) |
| ***A45D 1/08*** | (2006.01) |
| ***A45D 1/14*** | (2006.01) |

(Continued)

(52) U.S. Cl.

CPC ..... *A45D 19/16* (2013.01); *A45D 1/04* (2013.01); *A45D 1/08* (2013.01); *A45D 1/14* (2013.01); *A45D 1/18* (2013.01); *A45D 2/002* (2013.01); *A45D 2001/008* (2013.01); *A45D 2200/207* (2013.01)

(58) Field of Classification Search

CPC . A45D 2/001; A45D 1/02; A45D 1/06; A45D 1/04; A45D 19/16; A45D 2/002; A45D 1/08; A45D 1/14; A45D 1/18; A45D 2001/008; A45D 2001/207

See application file for complete search history.

(56) References Cited

U.S. PATENT DOCUMENTS

| | | | |
|---|---|---|---|
| 6,029,677 | A | 2/2000 | Nanba et al. |
| 6,119,702 | A | 9/2000 | Habibi |

(Continued)

FOREIGN PATENT DOCUMENTS

| | | | |
|---|---|---|---|
| JP | 1169936 | * | 1/2002 |
| WO | 2013/015693 | A1 | 4/2013 |

*Primary Examiner* — Cris L. Rodriguez
*Assistant Examiner* — Brianne E Kalach
(74) *Attorney, Agent, or Firm* — Koiitch Romano Dascenzo Gates LLC

(57) ABSTRACT

A hair-styling device may include a pair of articulated jaws having respective heating plates. At least one cartridge configured to contain a liquid may be included in one of or both of the jaws. The cartridge includes an ultrasonic transducer with micro-perforations configured to transform the liquid into a dispersion of droplets, and an outlet configured to deliver the dispersion of droplets, through a delivery cavity situated in at least one of the heating plates, to discharge ports distributed over a surface of the heating plate.

17 Claims, 8 Drawing Sheets

(51) Int. Cl.

| | |
|---|---|
| *A45D 1/18* | (2006.01) |
| *A45D 2/00* | (2006.01) |
| *A45D 1/00* | (2006.01) |

(56) References Cited

U.S. PATENT DOCUMENTS

| | | | | |
|---|---|---|---|---|
| 6,325,072 | B1 | 12/2001 | Smetana | |
| 6,357,449 | B1 * | 3/2002 | Chu | A46B 11/0041 132/112 |
| 8,757,175 | B1 * | 6/2014 | Leung | A45D 2/001 132/228 |
| 9,095,196 | B2 | 8/2015 | Leung | |
| 2006/0272665 | A1 * | 12/2006 | Yamamoto | A45D 2/00 132/207 |
| 2009/0014024 | A1 * | 1/2009 | Wong | A45D 1/12 132/225 |
| 2009/0188516 | A1 * | 7/2009 | Catini | A45D 2/001 219/225 |
| 2010/0101598 | A1 * | 4/2010 | Ng | A45D 2/001 132/223 |
| 2012/0312320 | A1 * | 12/2012 | Humphreys | A45D 1/28 132/211 |
| 2016/0022008 | A1 * | 1/2016 | Rabe | G06T 7/0012 132/200 |

* cited by examiner

HAIR-STYLING DEVICE

FIELD

The present invention relates to the field of hair-styling devices, and in particular to that of hair straightening irons, comprising a device for wetting locks of hair.

STATE OF THE ART

Hair straightening irons, or straighteners, are well known by the person skilled in the art. The majority of devices for styling and straightening the hair are based on the principle of passing locks of hair between two jaws that comprise heating plates. It has been proposed to spray water on the locks of hair when they are heated to improve the straightening effect, such that the hair-styling time is significantly reduced.

Documents U.S. Pat. Nos. 6,119,702; 6,029,677 and 6,325,072 disclose hair straighteners with two jaws comprising heating plates, wherein one of the plates is perforated. Vaporized water penetrates through the perforations to reach the lock positioned between the two jaws. However, before using the appliance, the user must wait for the water to get sufficiently heated to be vaporized.

Document U.S. Pat. No. 9,095,196 describes an iron with two heating plates situated on two respective jaws, and comprising a cartridge situated on one of the two jaws. The cartridge comprises a reservoir for containing a liquid hair-treatment agent and an ultrasound probe such as a piezoelectric transducer. The piezoelectric transducer oscillates when it is activated, which makes it possible to generate an atomization of droplets of the liquid agent contained in the reservoir. The dispersed agent in the cartridge is atomized between the two jaws, which makes it possible to straighten the hair.

AIMS

The aim of the present disclosure is to overcome the disadvantages of the state of the art. It is particularly aimed at providing a hair-styling device in the form of a hair straightening iron that provides the means for instant and homogeneous wetting of the locks of hair clamped between the heating plates.

SUMMARY

The present disclosure describes a hair-styling device that comprises two articulated jaws, with heating plates, the device comprising at least one cartridge which, in use, contains a liquid, said cartridge comprising an ultrasonic transducer with micro-perforations that allow the liquid to be transformed, in use, into a dispersion of droplets, said at least one cartridge comprising an outlet making it possible to deliver said dispersion of droplets, through a delivery cavity situated in at least one of the heating plates, to discharge ports.

The invention comprises at least one or a suitable combination of the following features:

- the device comprises means for adjusting the frequency and/or the amplitude of vibration of the transducer;
- the device comprises means for servo-controlling the intensity of the transducer upon opening of the jaws and the servo-control means comprise means for detecting the degree of opening of the jaws that are linked to the means for adjusting the frequency and/or the amplitude of vibration of the transducer;
- the cartridge comprises a reservoir and a transition space that connects the transducer and the reservoir, the transition space comprising an absorbent element that provides the means for maintaining continuous moisture in the proximity of said transducer;
- the cartridge comprises a groove within which an attachment ring comprising the ultrasonic transducer is fixed;
- the cartridge is removably mounted in a receiving hollow provided in the jaw;
- the device comprises a probe for detecting the fill level of the reservoir;
- the device comprises means for illuminating the dispersion of droplets;
- cover plates made of conductive material are situated over the jaws, the cover plates being able to be heated, in use, by at least one of the two heating plates by conduction and/or radiation;
- the device comprises an indicator of the temperature of the heating plates;
- the discharge ports increase in size towards the end of the hair-styling device to make the flow rate of the droplets uniform;
- different accessories may be placed around or slipped onto the contour of the jaws.

NUMERICAL REFERENCES OF THE FIGURES

Figure 1:
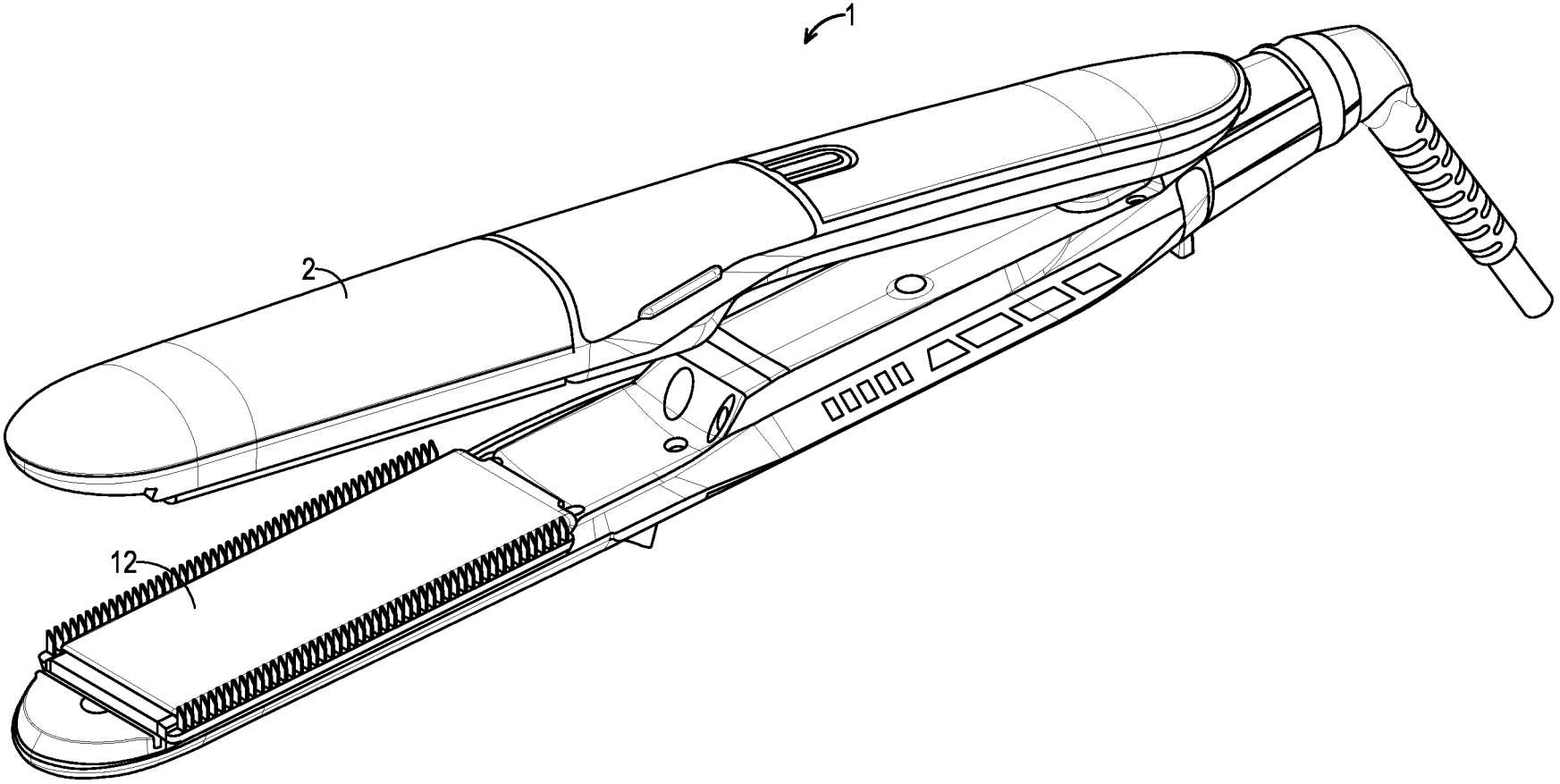
FIG. 1 shows a hair-styling device according to the present disclosure.

1. hair-styling device
2: articulated jaw

3: cartridge
4: recess
5: receiving hollow
6: reservoir
7: transition space
8: absorbent element
9: ultrasonic transducer
10: locking mechanism
11: discharge ports
12: heating plate
13: attachment ring
14: micro-perforations in the transducer
15: outlet of the cartridge
16: delivery cavity
17: reservoir cap
18: groove
19: means for illuminating the mist
20: comb
21: cover plates

DETAILED DESCRIPTION

The present disclosure describes a hair-styling device, and in particular a hair straightening iron 1 for styling hair.

The device as shown in FIG. 1 comprises two jaws 2 articulated between an open position and a closed position making it possible to clamp the locks of hair. The articulation can be implemented around a hinge incorporating a spring to maintain the two jaws 2 in the open position.

The two jaws 2 comprise heating plates 12 on the inner side of the jaws, that is to say in a manner such that the two plates 12 make it possible to compress the lock of hair in the closed position. These plates may be smooth, as shown in the figures, or include reliefs so as to create particular styling effects in the hair (waving, crimping, etc.). The plates 12 are heated by electrical means (resistors, ceramic plates, etc.).

Figure 2:
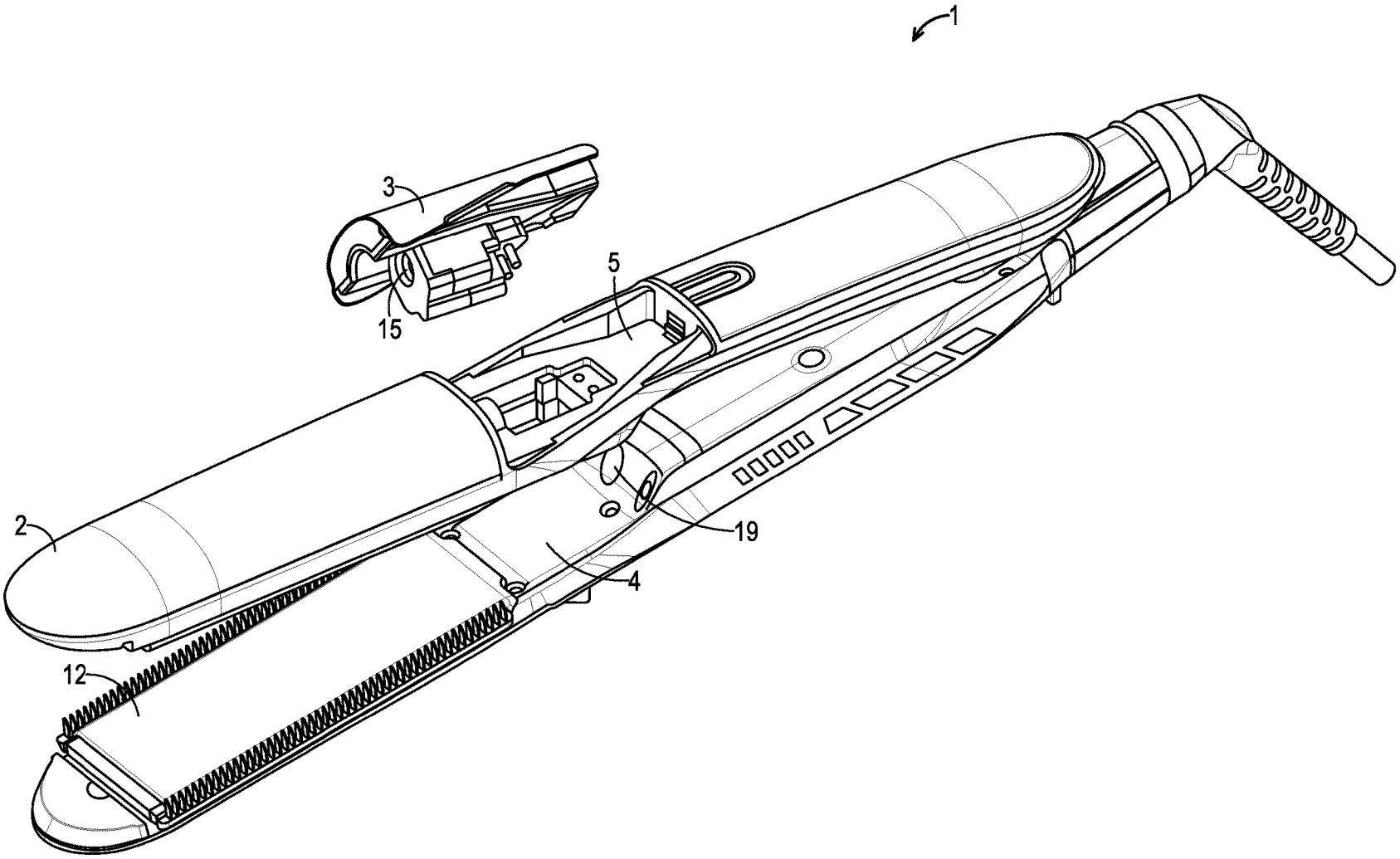
FIG. 2 shows an exploded view of the device of the present disclosure with the cartridge separated from the jaw.

The jaw 2 comprises a cartridge placed in a recess or hollow 5 provided for this purpose and which thereby reduces as far as possible any interference with the slender profile of the device, as illustrated in FIG. 2. Preferably, the cartridge 3 is removably mounted on this jaw 2.

A recess 4 is provided opposite it in the other jaw, that is to say the one not comprising the cartridge 3, which can accommodate the lower portion of the cartridge 3 when the two clamping jaws are in the closed position.

Figure 7:
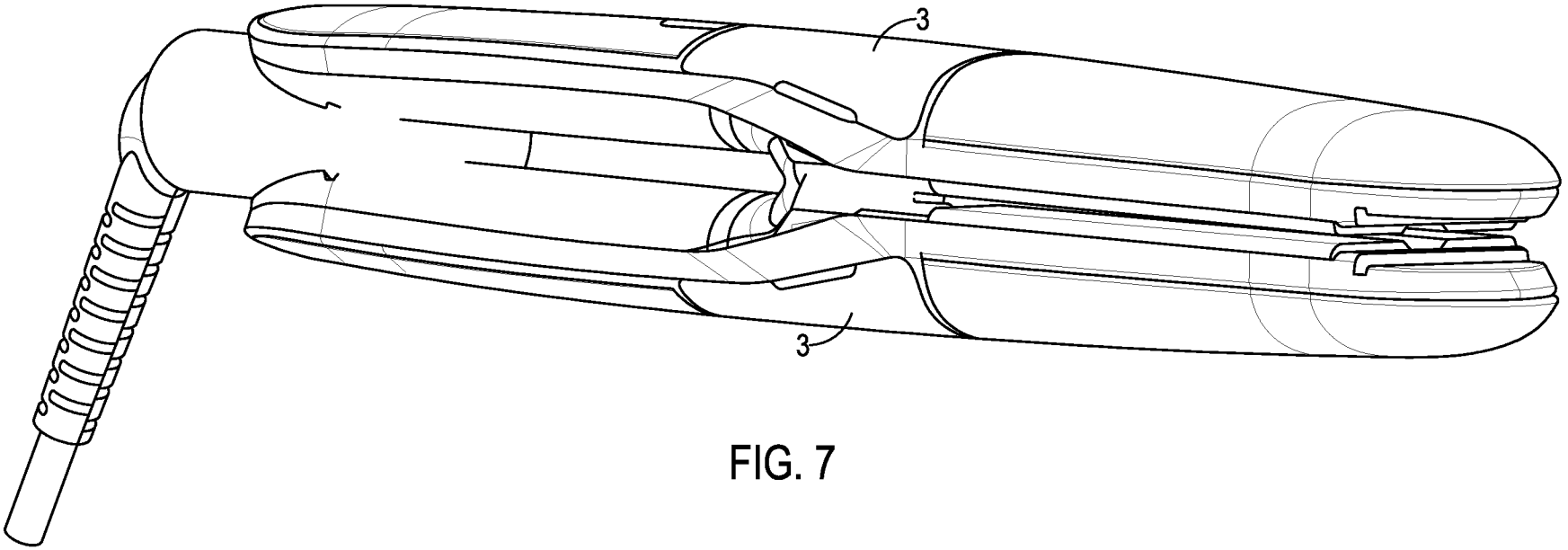
FIG. 7 shows a hair straightening iron according to the present disclosure comprising a cartridge fitted in each of the jaws, the jaws being in the closed position.
Figure 8:
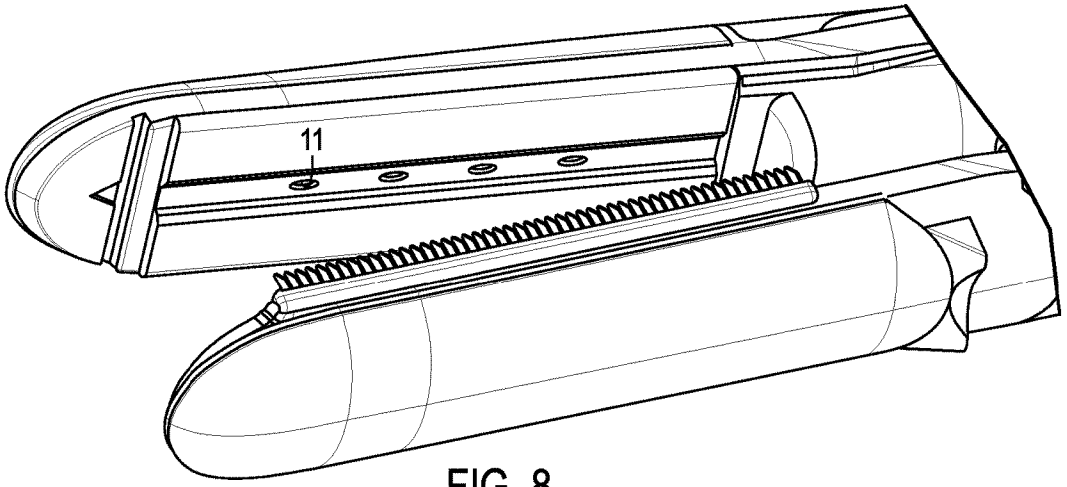
FIG. 8 shows a view of the two jaws half-open.

In a more efficient device of the invention, as represented in FIG. 7, each of the two jaws 2 may be equipped with a cartridge 3 to activate simultaneous misting on the two heating plates 12. On the other hand, the user can choose to activate misting on one or the other plate.

Figure 3:
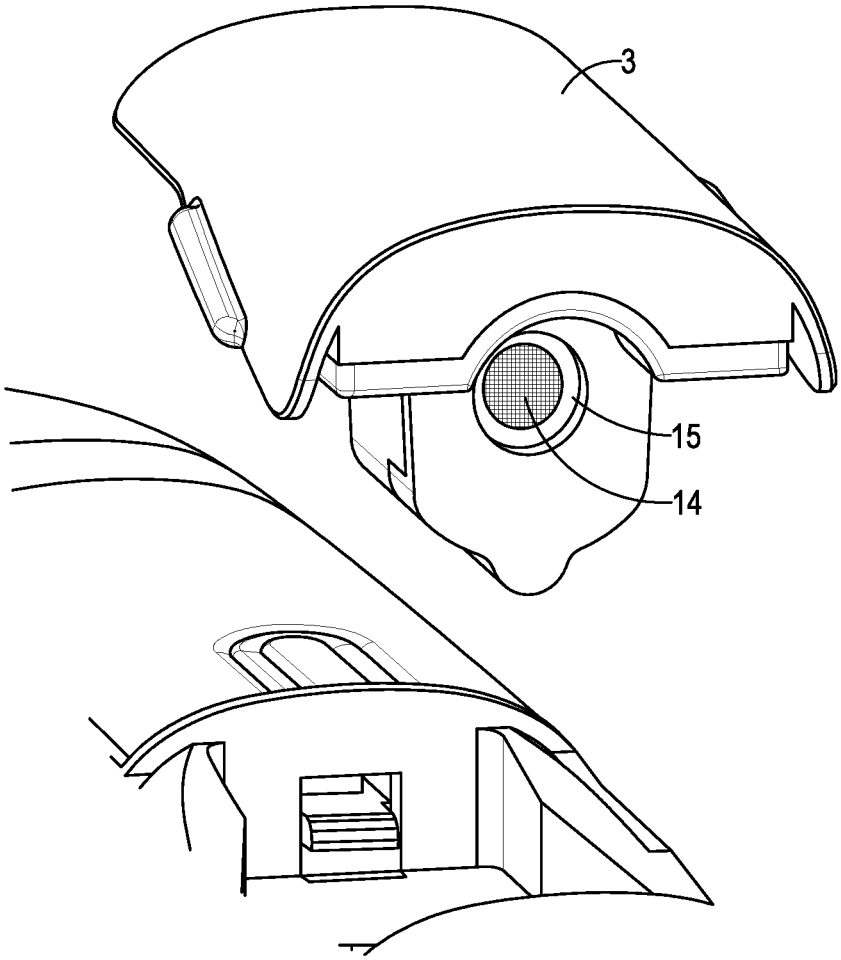
FIG. 3 shows an enlarged view of a cartridge of the device of the present disclosure.
Figure 4:
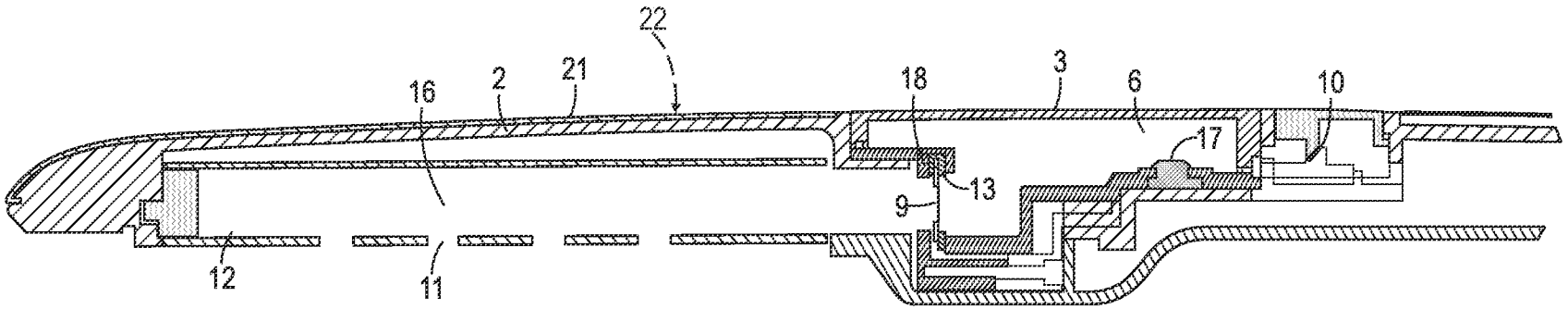
FIG. 4 shows a longitudinal section of one of the two jaws of the hair-styling device according to the present disclosure.

As illustrated in FIGS. 3 and 4, the cartridge 3 comprises a reservoir 6 which is able to contain a certain amount of liquid, preferably between 10 and 20 ml. The liquid contained is typically water but other types of liquid or additives are possible (argan oil, perfume, etc.) with a view to enhancing the aesthetical aspects and process of styling of hair.

On the other hand, the cartridge 3 comprises an ultrasound probe 9, such as a piezoelectric transducer or an equivalent element. The attachment of the piezoelectric transducer in the cartridge 3 is carried out by using a groove 18 that makes it possible to hold in place an attachment ring 13 which, in turn, provides the means to hold the transducer 9 in place through an outlet 15 of the cartridge. A seal, not shown, allows for the exclusive passage of the liquid to be misted through the transducer 9.

Thanks to the ultrasonic transducer 9, the liquid found in the reservoir of the cartridge 4 are transformed into a dispersion of fine droplets to form a mist. The dispersion of droplets escapes through the outlet 15 of the cartridge so as to pass through the delivery cavity 16 of the heating plate 12. The hollow 5 comprising the cartridge 3 is arranged so as to enable the outlet 15 to lead to the delivery cavity 16, as shown in FIG. 4.

Figure 10:
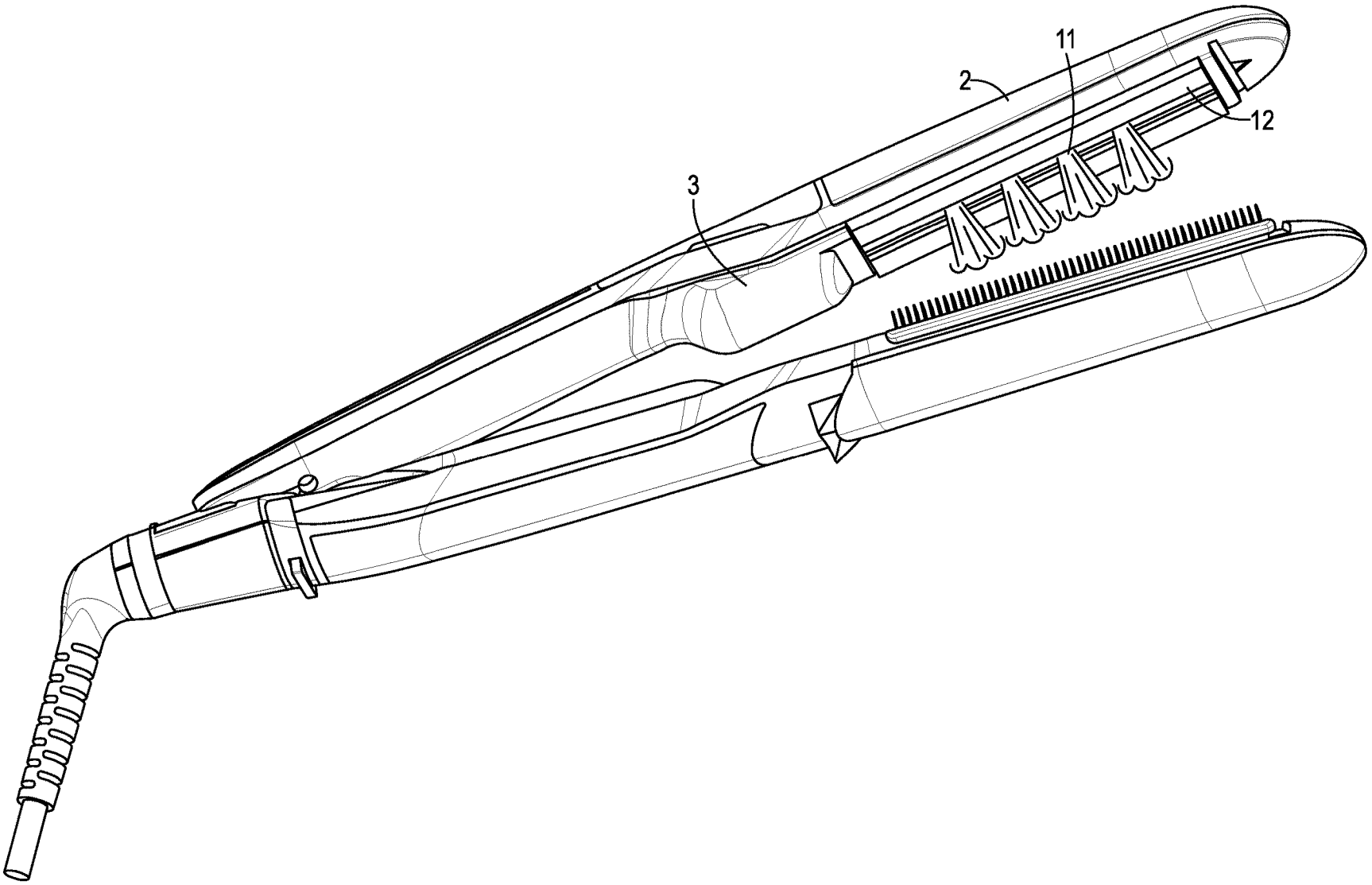
FIG. 10 shows a hair straightening iron according to the present disclosure, in use, with droplets spraying out of one of the jaws.

The transducer 9 further comprises one or more micro-perforations 14 making it possible to discharge the droplets towards the delivery cavity 16. The heating plate 12 comprises discharge ports 11 distributed over its surface, through which the droplets will be evacuated. In this manner, the lock of hair positioned between the two jaws is dampened by the microdroplets, as illustrated in FIG. 10.

Figure 11:
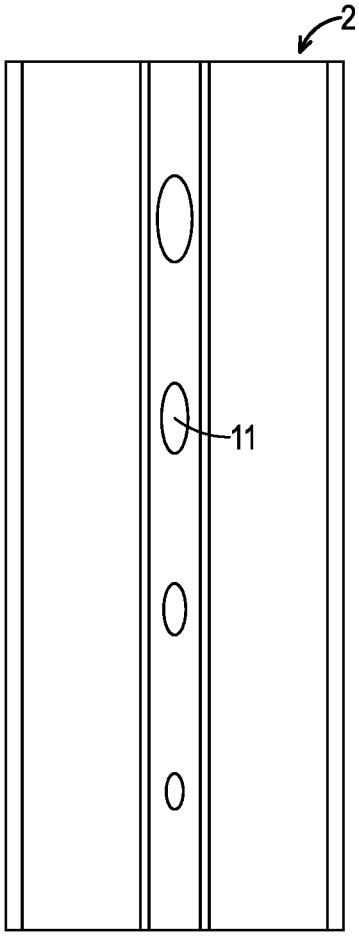
FIG. 11 shows a first position for the openings with the openings becoming increasingly larger the farther they are from the articulation of the two jaws.
Figure 12:
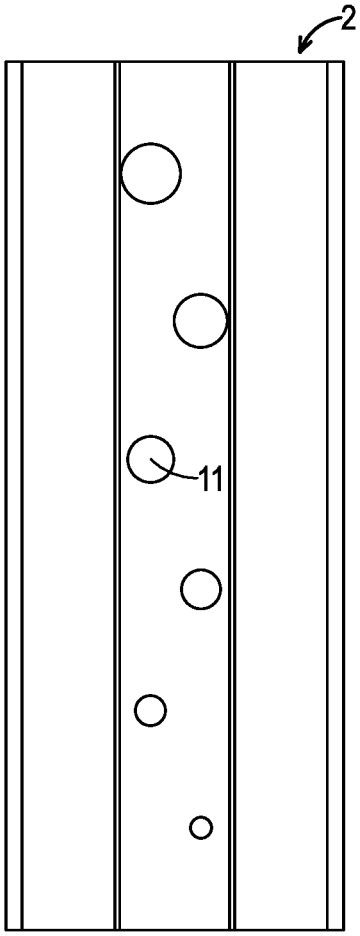
FIG. 12 shows a second position for the openings with the openings becoming increasingly larger the farther they are from the articulation of the two jaws.
Figure 13:
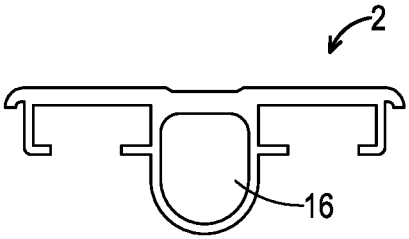
FIG. 13 shows the respective sections of the heating plates shown in FIG. 11.
Figure 14:
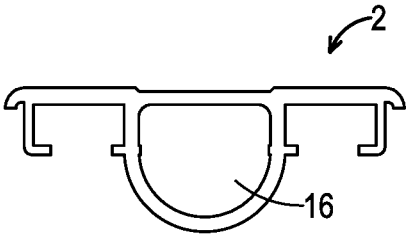
FIG. 14 shows the respective sections of the heating plates shown in FIG. 12.

The quantity, the size, and the distribution of the discharge ports 11 differ according to the embodiments of the invention. In FIG. 4, these are four in number and aligned at the center of the plate 12. FIGS. 11 and 12 illustrate other possible options for implementing the discharge ports 11. The discharge ports 11 shown in the FIG. 12 become increasingly larger towards the end of the plate opposite the articulation of the jaws, to make the flow rate of the droplets uniform.

The reservoir may be filled thanks to an opening comprising a plug or cap 17 situated on an inlet of the cartridge 3 on the reservoir 6. The opening is positioned preferably under the cartridge 3 and can be opened only when the cartridge is removed from the jaw 3. Moreover, the cartridge 3 is fastened to the jaw by way of a lock mechanism 10 which releases it from its hollow 5, as illustrated in FIG. 4.

The cartridge 3 further comprises one or more pins that make possible the power supply to the transducer 9. The pins are in communication with a switch for activating the transducer 9. Thus, during the mounting of the cartridge 3, the pins establish the electrical contact. In this manner, the production of mist is controlled by the user by way of the activation switch of the transducer 9.

Figure 5:
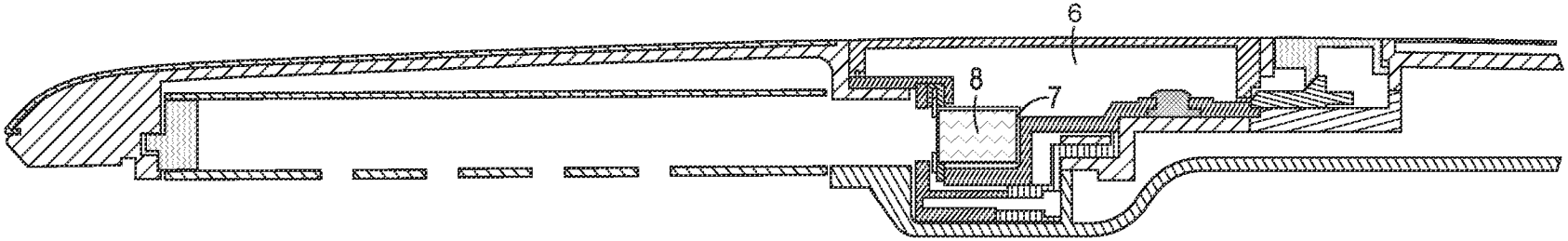
FIG. 5 shows a longitudinal section of one of the two jaws of a further embodiment of the hair-styling device according to the present disclosure.
Figure 6:
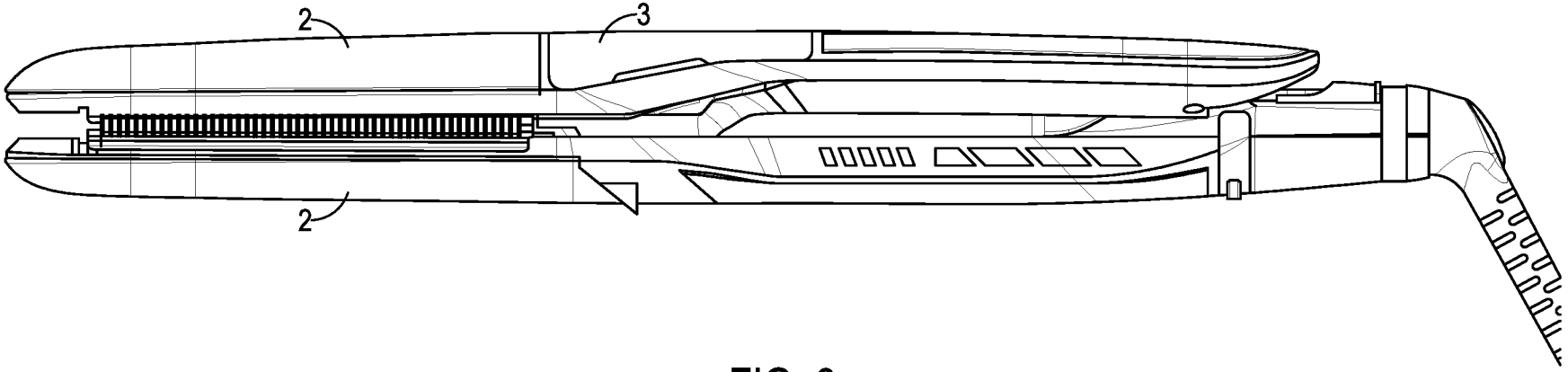
FIG. 6 shows a profile view of a hair straightening iron according to the present disclosure comprising the cartridge fitted in one of the jaws, the jaws being in the closed position.

In a preferred embodiment of the invention shown in FIG. 5, the cartridge 3 comprises a transition space 7, situated between the outlet 15 comprising the transducer 9 and the reservoir 6. This transition space 7 is in communication with the reservoir 6 and comprises an absorbent element 8, such as a sponge or felt, which absorbs a certain volume of liquid coming from the reservoir 6. The absorbent element 8 makes it possible to constantly maintain a level of moisture in the proximity of the transducer 9.

In one advantageous embodiment, means for adjusting the frequency and/or amplitude of the transducer are provided in order for the user to be able to adjust the amount of mist. In addition, an indicator for indicating the intensity of the mist may be provided.

A switch activating the heating means for the heating plates 12 is provided, as well as an indicator for indicating the state of activation of the heating means. An indicator of the temperature of the heating plates 12 may also be provided.

In one preferred embodiment of the invention, a sensor for detecting the opening of the jaws is provided. Thanks to this, a saving in energy is brought about because the production of mist will stop if the jaws remain open too long. In this manner, if the time lapse for opening exceeds a certain threshold, the power supply of the receptacles will be cut off.

In addition, the hair straightening iron 1 of the invention may comprise means for servo-controlling the intensity of misting upon the opening of the jaws. The servo-control means comprise means for detecting the degree of opening of the jaws which are connected to the means for adjusting the frequency and/or amplitude of the transducer.

This makes it possible to provide a highly effective misting, which will be intensified with the closing of the hair straightening iron 1, that is to say when the hair is clamped therein. In this way, the hair straightening iron makes it possible to save energy during the use thereof.

In one particular embodiment of the invention, the hair straightening iron 1 comprises safety means making it possible to prevent it from exceeding a certain temperature threshold, generally of about 230° C.

The hair straightening iron of the invention may also comprise illuminating means 19, such as LEDs, so as to illuminate the mist coming out of the heating plates, as shown in FIG. 2. This illuminating means 19 is positioned between the jaws.

A probe for detecting the fill level may be situated on the reservoir 6 to indicate, by way of a light-based, sound-based, or other type of signal, the absence of liquid in the reservoir 6.

Figure 9:
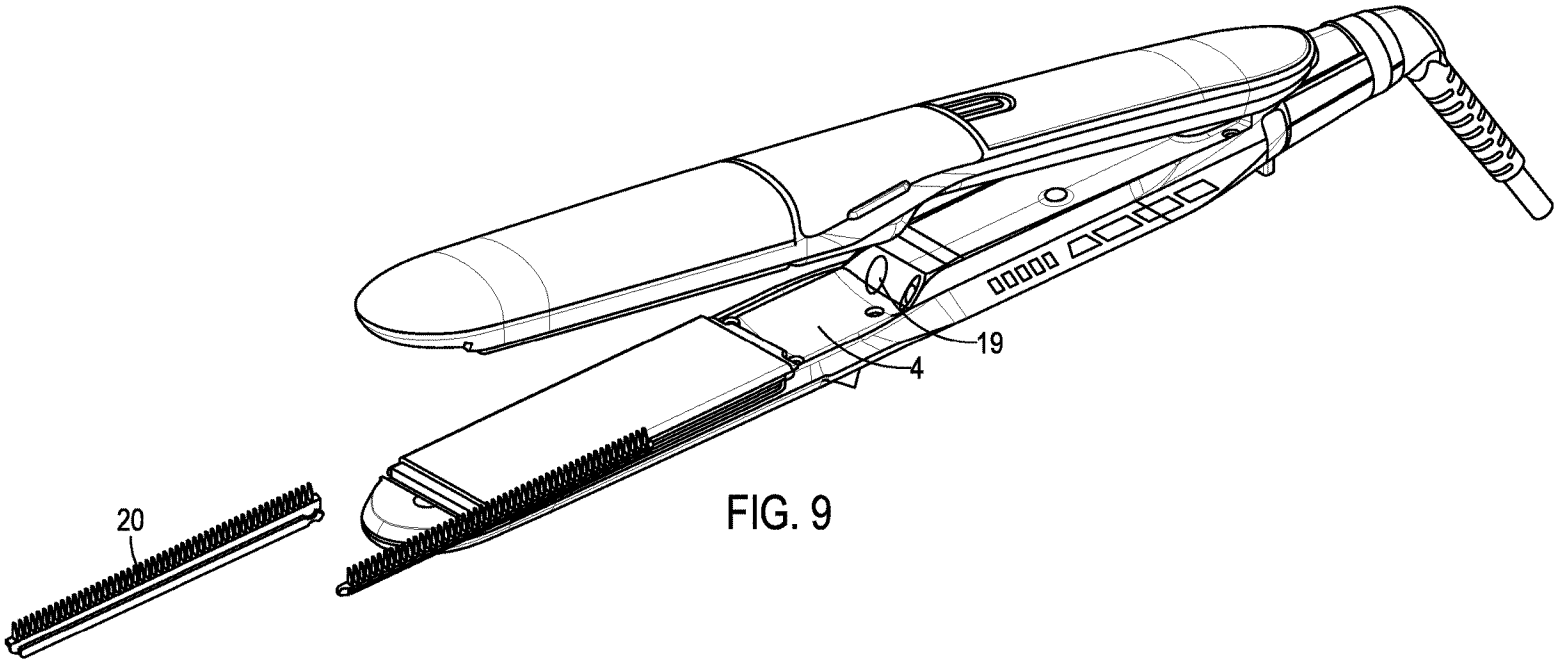
FIG. 9 shows a hair straightening iron according to the present disclosure with combs that are detachable from the jaws.

According to one particular embodiment of the invention, the jaws comprise combs 20 on their contour, which may be of various different sizes, heights and shapes. The combs 20 may be provided for different uses. FIG. 9 shows a hair straightening iron 1 according to the invention with combs 20 that are detachable from the jaws.

The hair straightening iron may also comprise cover plates 21 situated on the external or outer surfaces of the jaws 2 (FIG. 4). These plates are smooth or comprise reliefs 22 to give some shape to the hair wrapped around the hair straightening iron. The plates are heated by conduction and/or radiation.

The ultrasonic transducer 9 may be deactivated at any time by way of the activation switch of the transducer. It can also be activated without the heating means of the heating plates being activated. When the cartridge 4 is empty, or if the user wishes to add an agent therein, the cartridge 4 is removed by unlocking the locking mechanism 10.

The following series of paragraphs is presented without limitation to describe additional aspects and features of the disclosure:

A0. A hair-styling device (1) that comprises two articulated jaws (2), with heating plates (12), the device comprising at least one cartridge (3) which, in use, contains a liquid, said cartridge comprising an ultrasonic transducer (9) with micro-perforations (14) allowing the liquid to be transformed, in use, into a dispersion of droplets, said at least one cartridge (3) comprising an outlet (15) making it possible to deliver said dispersion of droplets, through a delivery cavity (16) situated in at least one of the heating plates, to discharge ports (11).

A1. The hair-styling device (1) according to paragraph A0, characterized in that said device comprises means for adjusting the frequency and/or the amplitude of vibration of the transducer.

A2. The hair-styling device according to paragraph A1, characterized in that said device comprises means for servo-controlling the intensity of the transducer upon the opening of the jaws, said servo-control means comprising means for detecting the degree of opening of the jaws linked to the means for adjusting the frequency and/or the amplitude of vibration of the transducer.

A3. The hair-styling device according to any one of paragraphs A0 through A2, characterized in that the cartridge (3) comprises a reservoir (6) and a transition space (7) that connects the transducer (9) and the reservoir (6), said transition space (7) comprising an absorbent element (8) that provides the means for maintaining continuous moisture in the proximity of said transducer (9).

A4. The hair-styling device according to any one of paragraphs A0 through A3, characterized in that the cartridge (3) comprises a groove (18) within which an attachment ring (13) comprising the ultrasonic transducer (9) is attached.

A5. The hair-styling device according to any one of paragraphs A0 through A4, characterized in that the cartridge (3) is removably mounted in a receiving hollow (5) provided within the jaw (2).

A6. The hair-styling device according to any one of paragraphs A0 through A5, characterized in that said device comprises a probe for detecting the fill level of the reservoir (6).

A7. The hair-styling device according to any one of paragraphs A0 through A6, characterized in that said device comprises means for illuminating the dispersion of droplets (19).

A8. The hair-styling device according to any one of paragraphs A0 through A7, characterized in that cover plates (30) made of conductive material are attached over the jaws (2), the cover plates being able to be heated, in use, by at least one of the two heating plates (2) by conduction and/or radiation.

A9. The hair-styling device according to any one of paragraphs A0 through A8, characterized in that the device comprises an indicator of the temperature of the heating plates.

A10. The hair-styling device according to any one of paragraphs A0 through A9, characterized in that the discharge ports (11) increase in size towards the end of the hair-styling device (1) in order to make the flow rate of the droplets uniform.

A11. The hair-styling device according to any one of paragraphs A0 through A10, characterized in that various different accessories (20) may be slipped onto the contour of the jaws (2).

The invention claimed is:

1. A hair-styling device comprising:

two articulated jaws having respective heating plates; and at least one cartridge configured to contain a liquid, the at least one cartridge comprising:

an ultrasonic transducer with micro-perforations configured to transform the liquid into a dispersion of droplets, and an outlet configured to deliver the dispersion of droplets, through a delivery cavity situated in at least one of the heating plates, to discharge ports comprising a plurality of spaced-apart apertures distributed over a surface of the at least one of the heating plates;

wherein a frequency and/or an amplitude of vibration of the transducer is adjusted automatically in response to a measured degree of opening of the laws.

2. The hair-styling device according to claim 1, wherein the cartridge includes a reservoir and a transition space that connects the transducer and the reservoir, the transition space including an absorbent element configured to maintain continuous moisture in the proximity of the transducer.

3. The hair-styling device according to claim 1, wherein the cartridge has a groove in which an attachment ring comprising the ultrasonic transducer is fixed.

4. The hair-styling device according to claim 1, wherein the cartridge is removably mounted in a receiving hollow provided in one of the two jaws.

5. The hair-styling device according to claim 1, further comprising a means for illuminating the dispersion of droplets.

6. The hair-styling device according to claim 1, wherein cover plates made of conductive material are attached over the jaws, wherein the cover plates are configured to be heated by at least one of the two heating plates via conduction and/or radiation.

7. The hair-styling device according to claim 1, further comprising an indicator of a temperature of the heating plates.

8. The hair-styling device according to claim 1, wherein the discharge ports increase in size toward a distal end of the hair-styling device.

9. The hair-styling device according to claim 1, wherein a contour of the jaws is configured to receive one or more accessories thereon.

10. A hair-styling device comprising:

a first jaw articulably coupled to a second jaw, each of the first and second jaws including a respective heating plate; and at least one cartridge removably mounted in a receiving hollow of the first jaw and configured to contain a liquid, the at least one cartridge comprising:

an ultrasonic transducer with micro-perforations configured to transform the liquid into a dispersion of droplets, and an outlet configured to deliver the dispersion of droplets through a delivery cavity to discharge ports comprising a plurality of spaced-apart apertures distributed over a surface of the heating plate of the first jaw;

wherein a frequency and/or an amplitude of vibration of the ultrasonic transducer is adjusted automatically in response to a measured degree of opening of the first and second laws.

11. The hair-styling device according to claim 10, wherein the cartridge includes a reservoir and a transition space that connects the transducer and the reservoir, the transition space including an absorbent element configured to maintain continuous moisture in the proximity of the transducer.

12. The hair-styling device according to claim 10, wherein the cartridge has a groove in which an attachment ring comprising the ultrasonic transducer is fixed.

13. The hair-styling device according to claim 10, wherein cover plates made of conductive material are attached over the first and second jaws, wherein the cover plates are configured to be heated by at least one of the heating plates via conduction.

14. The hair-styling device according to claim 13, wherein the cover plates comprise reliefs configured to shape hair wrapped around the device.

15. The hair-styling device according to claim 10, wherein cover plates made of conductive material are attached over the first and second jaws, wherein the cover plates are configured to be heated by at least one of the heating plates via radiant heat.

16. The hair-styling device according to claim 15, wherein the cover plates comprise reliefs configured to shape hair wrapped around the device.

17. The hair-styling device according to claim 10, wherein the discharge ports increase in size toward a distal end of the hair-styling device.

* * * * *